US010116059B2

(12) United States Patent
Kim et al.

(10) Patent No.: US 10,116,059 B2
(45) Date of Patent: Oct. 30, 2018

(54) RERADIATION REPEATER

(71) Applicant: Samsung Electronics Co., Ltd., Gyeonggi-do (KR)

(72) Inventors: Hyun-Jin Kim, Seoul (KR); Byung-Chul Kim, Gyeonggi-do (KR); Young-Ju Lee, Seoul (KR); Dong-Kyu Choi, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 99 days.

(21) Appl. No.: 15/036,713

(22) PCT Filed: Jul. 7, 2015

(86) PCT No.: PCT/KR2015/007007

§ 371 (c)(1),
(2) Date: May 13, 2016

(87) PCT Pub. No.: WO2016/080621

PCT Pub. Date: May 26, 2016

(65) Prior Publication Data

US 2016/0352021 A1 Dec. 1, 2016

(30) Foreign Application Priority Data

Nov. 20, 2014 (KR) ..... 10-2014-0162729

(51) Int. Cl.
*H01Q 19/10* (2006.01)
*H01Q 15/14* (2006.01)
(Continued)

(52) U.S. Cl.
CPC ..... *H01Q 15/14* (2013.01); *H01Q 1/243* (2013.01); *H01Q 1/38* (2013.01); *H01Q 1/48* (2013.01);
(Continued)

(58) Field of Classification Search
CPC ..... H01Q 3/44; H01Q 3/46; H01Q 9/0407; H01Q 9/0414; H01Q 9/0464; H01Q 15/14;
(Continued)

(56) References Cited

U.S. PATENT DOCUMENTS 5,606,335 A 2/1997 English et al.
6,020,853 A * 2/2000 Richards ..... H01Q 1/38 343/700 MS
(Continued)

FOREIGN PATENT DOCUMENTS

EP 2 624 364 8/2013
JP 2008151583 7/2008
(Continued)

OTHER PUBLICATIONS

PCT/ISA/210 Search Report issued on PCT/KR2015/007007 (pp. 3).
(Continued)

*Primary Examiner* — Tho G Phan
*Assistant Examiner* — Patrick Holecek
(74) *Attorney, Agent, or Firm* — The Farrell Law Firm, P.C.

(57) ABSTRACT

According to an embodiment of the present invention, a reradiation repeater may comprise a dielectric substrate, a ground conductor provided on a surface of the dielectric substrate, and a plurality of unit cells provided on another surface of the dielectric substrate, wherein the unit cells reradiate radio waves in the same direction by directing the radio waves which are incident onto the unit cells at different angles to a same direction. The reradiation repeater may facilitate to select, e.g., an installation location and secure a good reradiation capability even when the installation environment is changed (e.g., a variation in the installation
(Continued)

location of base station facility), contributing to coverage of a shadow zone. The reradiation repeater may be implemented in various manners according to embodiments of the present invention.

10 Claims, 11 Drawing Sheets

(51) Int. Cl.
*H01Q 1/38* (2006.01)
*H01Q 1/24* (2006.01)
*H01Q 1/48* (2006.01)
*H01Q 3/46* (2006.01)

(52) U.S. Cl.
CPC ..... *H01Q 3/46* (2013.01); *H01Q 15/145* (2013.01); *H01Q 19/104* (2013.01)

(58) Field of Classification Search
CPC .... H01Q 15/147; H01Q 15/148; H01Q 19/10; H01Q 19/104; H01Q 1/243; H01Q 1/38; H01Q 1/48; H01Q 1/246
See application file for complete search history.

(56) References Cited

U.S. PATENT DOCUMENTS

| | | | | |
|---|---|---|---|---|
| 8,217,847 | B2 * | 7/2012 | Sotelo | H01Q 3/46 343/700 MS |
| 8,319,698 | B2 * | 11/2012 | Legay | H01Q 3/46 343/913 |
| 2009/0079645 | A1 | 3/2009 | Sotelo et al. | |
| 2010/0001918 | A1 | 1/2010 | Svensson et al. | |
| 2010/0265159 | A1 | 10/2010 | Ando et al. | |
| 2011/0115584 | A1 | 5/2011 | Kiji | |
| 2012/0050127 | A1 | 3/2012 | Maruyama et al. | |
| 2012/0105305 | A1 | 5/2012 | Maruyama et al. | |
| 2013/0229296 | A1 | 9/2013 | Maruyama et al. | |

FOREIGN PATENT DOCUMENTS

| | | |
|---|---|---|
| JP | 2010041566 | 2/2010 |
| JP | 2011109264 | 6/2011 |
| KR | 100703932 | 4/2007 |
| KR | 1020100051824 | 5/2010 |

OTHER PUBLICATIONS

PCT/ISA/237 Written Opinion issued on PCT/KR2015/007007 (pp. 5).

Arezou Edalati et al., "Wideband, Wide Angle, Polarization Independent RCS Reduction using Nonabsorptive Miniaturized-Element Frequency Selective Surfaces," IEEE Transactions on Antennas and Propagation, vol. 62, No. 2, Feb. 2014, 8 pages.

European Search Report dated Oct. 9, 2017 issued in counterpart application No. 15861214.3-1927, 12 pages.

* cited by examiner

RERADIATION REPEATER

PRIORITY

This application is a National Phase Entry of PCT International Application No. PCT/KR2015/007007, which was filed on Jul. 7, 2015, and claims priority to Korean Patent Application No. 10-2014-0162729, which was filed on Nov. 20, 2014, the contents of each of which are incorporated herein by reference.

TECHNICAL FIELD

Various embodiments of the present invention relate to repeaters, e.g., reradiation repeaters that radiate received radio waves in different directions.

BACKGROUND ART

Wireless communication techniques are implemented in various ways, such as wireless local area network (w-LAN) represented by Wi-Fi, Bluetooth, and near field communication (NFC), as well as by commercialized mobile communication network access technologies. Mobile communication services, starting with 1st-generation, voice-centered mobile communication services, are evolving to high-speed, high-capacity services (e.g., high-quality video streaming services). Next-generation mobile communication services are predicted to be served through ultra-high-frequency bands of a few tens of GHz.

As communication standards such as WLAN or Bluetooth are widely used, electronic devices, e.g., mobile communication terminals, come with antenna devices that operate in various frequency bandwidths. For example, the fourth generation mobile communication service is operated in a frequency bandwidth of, e.g., 700 MHz, 1.8 GHz, or 2.1 GHz. Wi-Fi is operated in a frequency bandwidth of 2.4 GHz or 5 GHz, and Bluetooth is operated in a frequency bandwidth of 2.45 GHz, although slightly varied depending on their protocols.

The provision of stable service quality over a commercially available wireless communication network need meet a high antenna device gain and a broad beam coverage area. The next-generation mobile communication service is provided through an ultra-high-frequency bandwidth of a few tens of GHz (e.g., a frequency band within a range of about 30 GHz to about 300 GHz and with a resonant frequency wavelength of about 1 mm to 10 mm) and may thus require higher performance than the antenna device used in the legacy commercial mobile communication service presents.

Generally, as the operation frequency band increases, the straightness of radio wave may increase and loss as per transmission distance may increase. Further, as much as the increased radio wave straightness, attenuation of signal power or reflection loss by an obstacle (a building or geographic feature) may increase. Accordingly, a communication scheme with a high operation frequency may cause local shade zones in a building-dense area and significant variations in radio wave environment for partitioned spaces in the same building. Accordingly, such communication scheme with a high operation frequency bandwidth may provide an enhanced radio wave environment by turning the direction of radio waves to propagate to a shade zone.

SUMMARY

Thus, according to an embodiment of the present invention, there is provided a reradiation repeater that may cover a building dense area or shade zones in a building.

Further, according to an embodiment of the present invention, there is provided a reradiation repeater that may reradiate radio waves coming from different directions in the same direction.

Technical Solution

According to an embodiment of the present invention, a reradiation repeater may comprise a dielectric substrate, a ground conductor provided on a surface of the dielectric substrate, and a plurality of unit cells provided on another surface of the dielectric substrate, wherein the unit cells reradiate radio waves in the same direction by directing the radio waves which are incident onto the unit cells at different angles to a same direction.

According to an embodiment of the present invention, the reradiation repeater may be installed in a location with a good radio wave environment to reradiate incident radio waves in a different direction, allowing for an enhanced radio wave environment in a shadow zone. Further, since radio waves incident from different directions may be reradiated in the same direction by the structure or arrangement of unit cells, the reradiation repeater according to an embodiment of the present invention may facilitate to select an installation location and secure a good reradiation capability even when the installation environment is changed (e.g., a variation in the installation location of base station facility).

DESCRIPTION OF EXEMPLARY EMBODIMENTS

Various changes may be made to the present invention, and the present invention may come with a diversity of embodiments. Some embodiments of the present invention are shown and described in connection with the drawings. However, it should be appreciated that the present invention is not limited to the embodiments, and all changes and/or equivalents or replacements thereto also belong to the scope of the present invention.

The terms coming with ordinal numbers such as 'first' and 'second' may be used to denote various components, but the components are not limited by the terms. The terms are used only to distinguish one component from another. For example, a first component may be denoted a second component, and vice versa without departing from the scope of the present invention. The term "and/or" may denote a combination(s) of a plurality of related items as listed or any of the items.

The terms "front," "rear surface," "upper surface," and "lower surface" are relative ones that may be varied depending on directions in which the figures are viewed, and may be replaced with ordinal numbers such as "first" and "second." The order denoted by the ordinal numbers, first and second, may be varied as necessary.

The terms as used herein are provided merely to describe some embodiments thereof, but not to limit the present invention. It is to be understood that the singular forms "a," "an," and "the" include plural references unless the context clearly dictates otherwise. It will be further understood that the terms "comprise" and/or "have," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the embodiments of the present invention belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
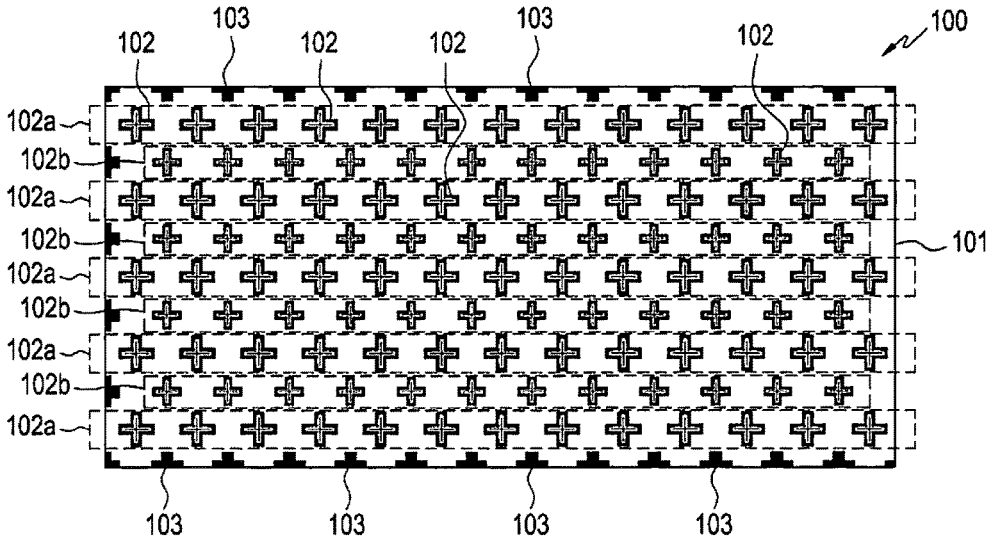
FIG. 1 is a view illustrating a reradiation repeater according to an embodiment of the present invention.
Figure 2:
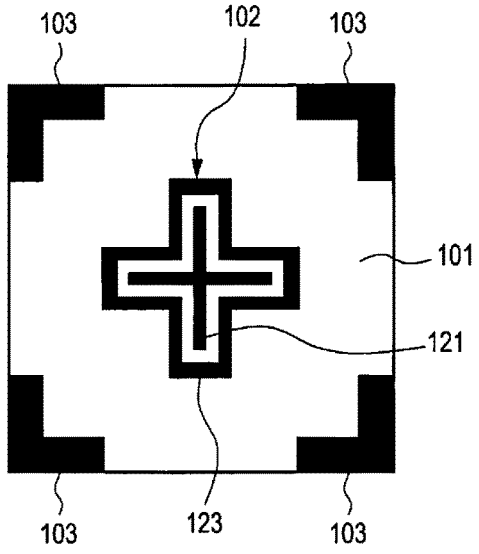
FIG. 2 is a view illustrating a unit cell arrangement of a reradiation repeater according to an embodiment of the present invention.
Figure 3:
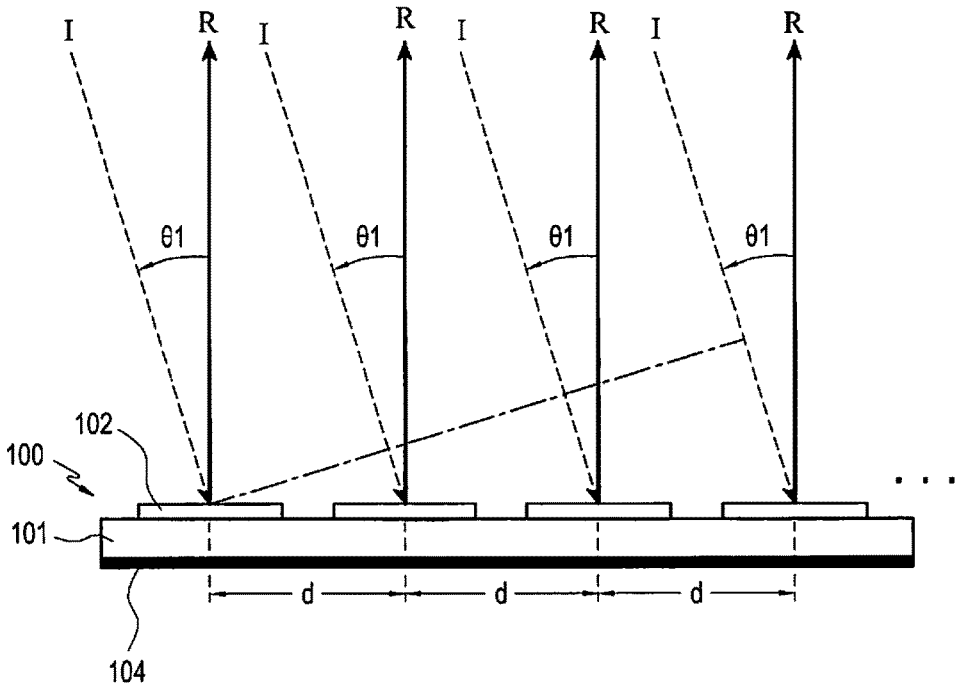
FIG. 3 is a view illustrating a configuration in which a reradiation repeater reradiates radio waves to a front (a zero-degree direction) according to an embodiment of the present invention.

FIG. 1 is a view illustrating a reradiation repeater 100 according to an embodiment of the present invention. FIG. 2 is a view illustrating a unit cell (102) arrangement of a reradiation repeater according to an embodiment of the present invention. FIG. 3 is a view illustrating a configuration in which a reradiation repeater 100 reradiates radio waves to a front (a zero-degree direction) according to an embodiment of the present invention.

Referring to FIGS. 1 to 3, the reradiation repeater 100 may include at least one unit cell 102 arranged on a surface of a dielectric substrate 101 to reradiate an incident radio wave I in a different direction. Multiple unit cells 102 may be arranged on the surface of the dielectric substrate 101. The propagation width, direction, or directivity of the reradiated radio wave R may be set by the size, array, and position of the unit cells 102. The reradiation repeater 100 may include a ground conductor 104 on an opposite surface of the dielectric substrate 101 to enhance the propagation width, direction, or directivity of the reradiated radio wave R. For example, the reradiation repeater 100 may receive a plane wave and reradiate the received plane wave in a direction different from the incident direction even without power supply.

The dielectric substrate 101 may be an opaque, hard substrate formed of a material, such as FR4, polyamide, or graphene. Further, the dielectric substrate 101 may be made transparent or flexible. The dielectric substrate 101 may be formed in a planar or curved shape depending on the environment where the reradiation repeater 100 is mounted. The ground conductor 104 may be a conductive layer formed on the opposite surface of the dielectric substrate 101 by, e.g., plating or deposition. The ground conductor 104 may provide a ground forming a reference potential for the unit cells 102.

The unit cell 120 may include a plurality of conductive patterns 121 and 123. The conductive patterns 121 and 123 may be formed of a metal, e.g., a transparent material, such as indium-tin oxide (ITO). For example, if the dielectric substrate 101 is formed of a transparent or semi-transparent material, the unit cell 102 may also be formed of a transparent material. The conductive patterns may include, e.g., a first conductive pattern 121 and a second conductive pattern 123 formed to surround the first conductive pattern 121. The first conductive pattern 121 may have, e.g., a "+" shape, and the second conductive pattern 123 may have a closed loop shape spaced apart from the first conductive pattern 121. The second conductive pattern 123 may be shaped to surround the first conductive pattern 121 while spaced apart from the first conductive pattern 121. The second conductive pattern 123 may have a similar shape to the first conductive pattern 121.

According to a specific embodiment of the present invention, although the first conductive pattern 121 is disclosed to have a + shape, the present invention is not limited thereto. For example, the first conductive pattern 121 may have a "−" shape, a polygonal shape including a triangle or diamond, a circular shape or an elliptical shape. The second conductive pattern 123 need not be limited to the shape shown in the drawings. For example, if the first conductive pattern 121 has a "−" shape, the second conductive pattern 123 may be shaped as a rectangle surrounding the first conductive pattern 121 while spaced apart from the first conductive pattern 121.

As described below, the unit cells 102 may have the characteristic of delaying the phase of the reradiated radio wave R with respect to the incident radio wave I depending on the length or interval between first and second conductive patterns 121 and 123 of the unit cells 102. The incident plane wave may be reradiated in a different direction as set by arranging the unit cells 102 on the dielectric substrate 101. For example, unless the unit cells 102 have the phase delay characteristic, the plane wave having an incident angle of −10 degrees with respect to the front of the dielectric substrate 101 may be reradiated in a direction of +10 degrees. According to an embodiment of the present invention, the angular direction in which the incident radio wave I is reradiated may be set by the respective phase delay characteristics of the unit cells 102 and the interval of the arrayed unit cells 102. For example, if the phase difference as per position of two adjacent unit cells 102 is 10 degrees for a plane wave incident from a direction (e.g., an incident angle θ1) inclined with respect to the front of the dielectric substrate 101, the reradiation repeater 100 may be designed so that one of the unit cells has a phase delay characteristic of 10 degrees with respect to the other unit cell, and thus, the reradiation repeater 100 may reradiate the incident plane wave in a front direction (a 0-degree direction).

Referring to FIG. 3, the phase difference between unit cells 102 for the plane wave with an incident angle θ1 may be calculated by the following Equation 1.

$$\Delta\psi=\beta d \sin \theta 1=2\pi d \sin \theta 1/\lambda \quad \text{[Equation 1]}$$

Here, Δψ may mean a phase difference between two unit cells, β a phase constant, d a distance between two adjacent unit cells, and λ a wavelength of an incident plane wave.

As set forth above, if there is a phase difference Δψ between the two unit cells for the incident plane wave, the reradiation repeater 100 may reradiate the plane wave incident at angle θ1 to the front of the dielectric substrate 101 (a 0-degree direction) by allowing one of the two unit cells to have a phase delay characteristic corresponding to Δψ.

Figure 4:
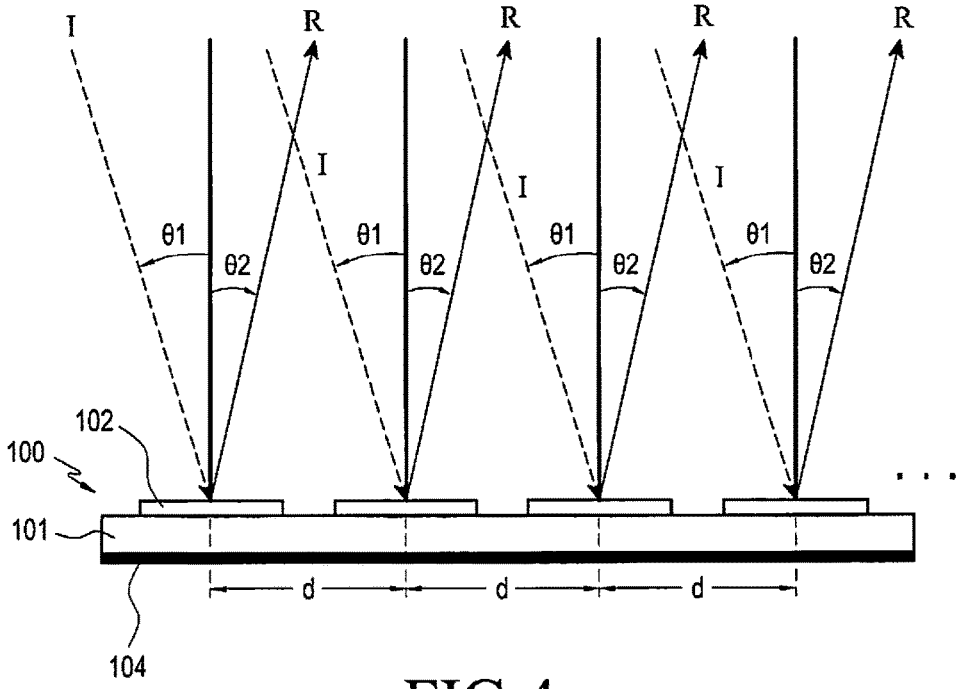
FIG. 4 is a view illustrating a configuration in which a reradiation repeater reradiates radio waves in a direction inclined with respect to a front according to an embodiment of the present invention.

FIG. 4 is a view illustrating a configuration in which a reradiation repeater 100 reradiates radio waves in a direction inclined with respect to a front surface according to an embodiment of the present invention.

Referring to FIG. 4, according to an embodiment of the present invention, the reradiation repeater 100 may reradiate an incident plane wave not only in a front direction (a 0-degree direction) but also in another direction inclined with respect to the front. For example, in case of reradiating a radio wave I incident in a θ1-degree direction in a θ2-degree direction, the phase difference between two unit cells for the incident plane wave may be calculated by the following Equation 2.

$$\Delta\psi=\beta d(\sin \theta 1-\sin \theta 2) \quad \text{[Equation 2]}$$

Here, Δψ may mean a phase difference between two unit cells, β a phase constant, and d a distance between two adjacent unit cells. For example, the reradiation repeater 100 may reradiate the radio wave I incident in the θ1-degree direction in the θ2-degree direction by designing the phase difference between the two unit cells arranged on the dielectric substrate 101 to be Δψ and leaving as large an interval as d.

Figure 5:
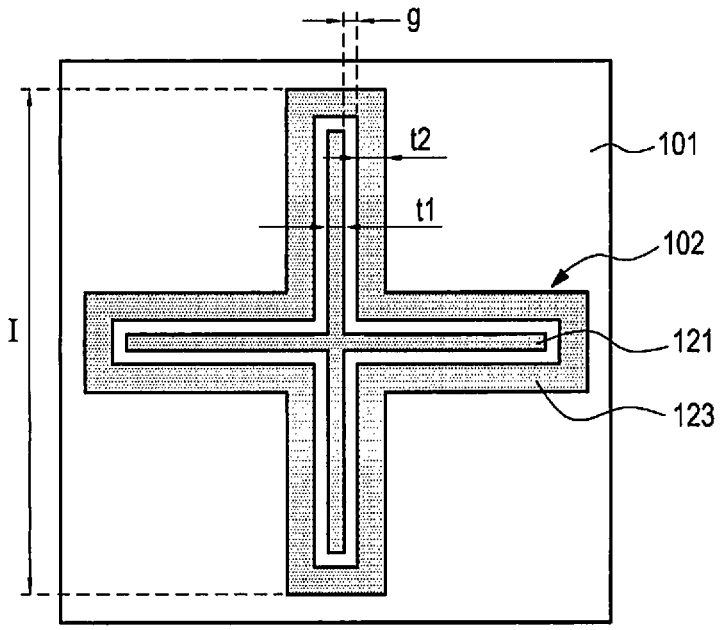
FIG. 5 is a plan view illustrating a unit cell of a reradiation repeater according to an embodiment of the present invention.
Figure 6:
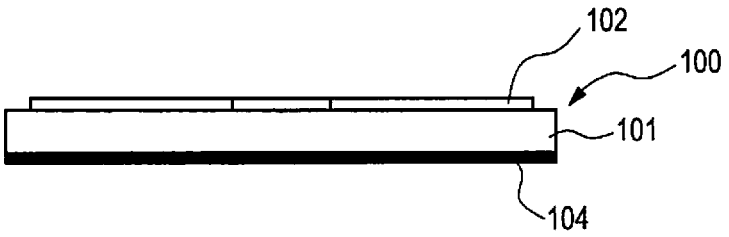
FIG. 6 is a side view illustrating a unit cell of a reradiation repeater according to an embodiment of the present invention.
Figure 7:
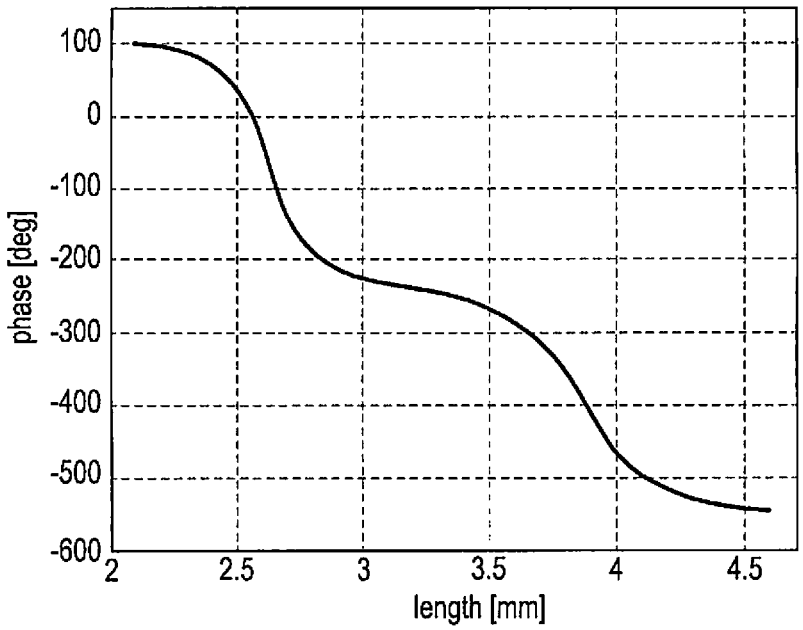
FIG. 7 is a graph illustrating a phase characteristic of a unit cell of a reradiation repeater according to an embodiment of the present invention.

FIG. 5 is a plan view illustrating a unit cell 102 of a reradiation repeater 100 according to an embodiment of the present invention. FIG. 6 is a side view illustrating a unit cell 102 of a reradiation repeater 100 according to an embodiment of the present invention. FIG. 7 is a graph illustrating a phase characteristic of a unit cell 102 of a reradiation repeater 100 according to an embodiment of the present invention.

Referring to FIGS. 5 to 7, the phase characteristic of each unit cell 102 may be determined by the length I of the unit cells 102 and the interval g between the first and second conductive patterns 121 and 123. Referring to FIG. 5, the surface impedance Zs in the structure of the unit cell 102 may be calculated by the following Equation 3.

$$Zs = \frac{jwL}{1 - w^2LC} \quad \text{[Equation 3]}$$

Here, the inductance component L may be determined by the length I of the unit cell and the thicknesses t1 and t2 of the first and second conductive patterns 121 and 123, and the capacitance component C may be determined by the length I of the unit cell 102 and the interval g between the first and second conductive patterns 121 and 123.

The relation between the surface impedance Zs and the phase delay characteristic of the unit cell 102 may be represented as the following Equation 4.

$$\Gamma = \frac{Zs - \eta}{Zs + \eta} = |\Gamma| \exp(j\phi) \quad \text{[Equation 4]}$$

Here, Γ may mean the reflection coefficient of the unit cell, η the free space impedance, and φ the phase delay characteristic of the unit cell. It could be found that the relation between the length I of the unit cell and the phase delay characteristic (e.g., the phase difference of the reradiated radio wave R with respect to the incident radio wave I), as calculated by the above equations, is shown as the graph of FIG. 7. For example, a unit cell configured to be 2.5 mm long may have a phase delay characteristic of about 30 degrees to about 45 degrees. For brevity of description, although the variable of the phase delay characteristic of the unit cell 102 is exemplified only for the length I of the unit cell, the thicknesses t1 and t2 of the first and second conductive patterns 121 and 123 or the interval g between the first and second conductive patterns 121 and 123 may also be used as variables to set the phase delay characteristic as described above.

Considering the above-described phase delay characteristic of unit cell 102, the size of the two unit cells may be set by taking into account the incident angle of radio wave and the direction (e.g., a reradiated angle) in which reradiation is performed. For example, the unit cell having a phase delay characteristic of −100 degrees may be found to have a size of about 2.7 mm in the graph shown in FIG. 7. The unit cell having a phase difference of 100 degrees with respect to the unit cell having a phase delay characteristic of −100 degrees may be designed to have a size of about 2.6 mm or about 2.8 mm. As such, upon determination of the interval between the two unit cells and the incident angle and reradiated angle of the radio wave, the phase difference between the two unit cells may be calculated from Equation 1 or 2 above. If the phase difference between the two unit cells is calculated, the size of the two unit cells may be set by the length of the unit cells calculated by Equations 3 and 4 and the phase delay characteristic (e.g., the graph shown in FIG. 7).

The process of calculating the phase difference between the unit cells 102 and designing the unit cells 102 based on the same is not necessarily limited to the above-described manner. As set forth above, e.g., since various changes may be made to the shape of the unit cells 102, if the reradiation repeater 100 is implemented in a different structure from those according to the above-described embodiments, the equations for calculating the phase difference or designing unit cells may be properly modified.

Referring back to FIG. 1, the multiple unit cells 102 may be assigned to one of a first cell group 102*a* where the radio wave I incident in the first incident angle direction is reradiated in the first radiation angle direction and a second cell group 102*b* where the radio wave I incident in a second incident angle direction different from the first incident angle is reradiated in the first radiation angle direction. For example, the first cell group 102*a* may be formed of an array of unit cells reradiating a plane wave incident to the reradiation repeater 100 from a −10-degree direction in a 60-degree direction. The second cell group 102*b* may be formed of an array of unit cells reradiating a plane wave incident to the reradiation repeater 100 from a −30-degree direction in the 60-degree direction. The first and second cell groups 102*a* and 102*b* may be alternately and crossingly arranged on a surface of the dielectric substrate 101.

According to an embodiment of the present invention, the unit cells in the first cell group 102*a* may be arranged in a left area on the dielectric substrate 101 shown in FIG. 1, and the unit cells in the second cell group 102*b* may be arranged in a right area on the dielectric substrate 101. For example, the first and second cell groups 102*a* and 102*b* may be arranged in two separated areas on a surface of the dielectric substrate 101 rather than crossingly arranged.

Configuring and arranging the unit cells to be assigned to the first and second cell groups 102*a* and 102*b* may allow the reradiation repeater 100 to reradiate plane waves respectively incident from two different directions (e.g., a −10-degree direction and a −30-degree direction) i the same direction (e.g., a 60-degree direction). According to an embodiment of the present invention, as compared with the structure in which a surface of the dielectric substrate 101 is divided into two areas where the first and second cell groups 102*a* and 102*b* are arranged, the structure in which the first and second cell groups 102*a* and 102*b* are arranged to cross each other could be found to enhance an output of reradiated radio wave R by about 3 dB. This is why the crossed arrangement of the first and second cell groups 102*a* and 102*b* may increase the area where the incident radio wave I may be reradiated.

According to an embodiment of the present invention, the reradiation repeater 100 may include dummy patterns 103 arranged on a surface of the dielectric substrate 101. The dummy patterns 103 may be arranged along an edge of an area where the unit cells 102 are arrayed, e.g., an edge of a surface of the dielectric substrate 101. The unit cells 102 may be arrayed to form a predetermined pattern (regularly) or irregularly on a surface of the dielectric substrate 101. In case the unit cells 102 are arrayed to have a predetermined pattern, the unit cells arranged on the edge may be left to an operational environment different from that of the other unit cells. For example, a unit cell arranged between the other unit cells may have a different operational environment from that of a unit cell disposed adjacent to the edge on the dielectric substrate 101. According to an embodiment of the present invention, as the reradiation repeater 100 includes the dummy patterns 103, the unit cells arranged adjacent to the edge on the dielectric substrate 101 may be formed to be similar in operational environment to the other unit cells (e.g., unit cells between unit cells).

FIGS. 8 to 11 are graphs illustrating measured reradiation characteristics of a reradiation repeater 100 according to an embodiment of the present invention.

Figure 8:
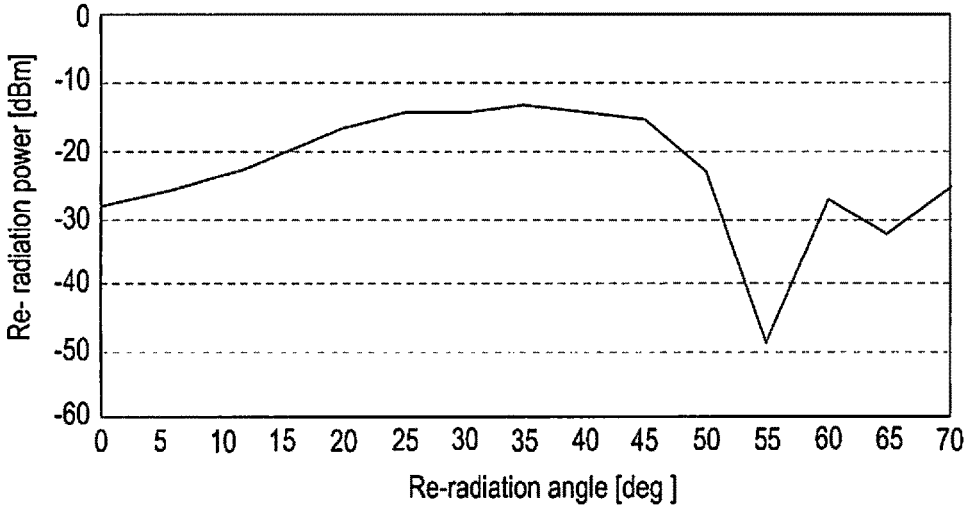
FIGS. 8 to 11 are graphs illustrating measured reradiation characteristics of a reradiation repeater according to an embodiment of the present invention.

FIG. 8 is a graph obtained by measuring a reradiation characteristic of a reradiation repeater designed to reradiate a radio wave I incident from a 0-degree direction in a 30-degree direction (hereinafter, a "first design") according to an embodiment of the present invention. It can be shown that the reradiation repeater according to the first design may reradiate a radio wave incident from the front (e.g., a 0-degree direction) in a direction within a range from about 20 degrees to about 45 degrees, e.g., a 30-degree direction.

Figure 9:
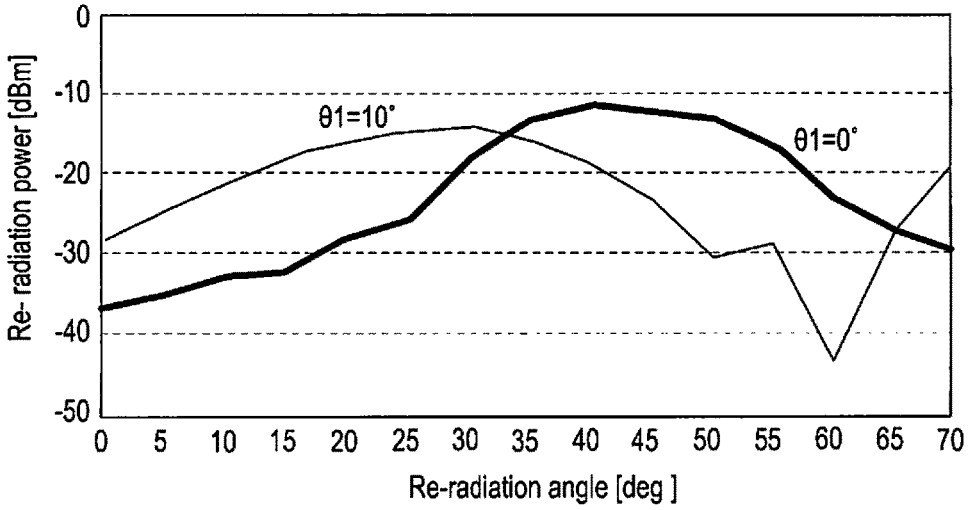

FIG. 9 is a graph obtained by measuring a reradiation characteristic of a reradiation repeater designed to reradiate a radio wave I incident from a 10-degree direction in a 30-degree direction (hereinafter, a "second design") according to an embodiment of the present invention. It can be shown that the reradiation repeater according to the second design may reradiate a radio wave I incident from a 10-degree direction in a 30-degree direction. It can be seen that when a radio wave is incident to the reradiation repeater according to the second design from the 0-degree direction, the reradiated radio wave R propagates in a direction of about 40 degrees. For example, in case the radio wave is incident to the reradiation repeater at an angle smaller than the designed angle, the reradiation angle may become larger than the designed angle. This is verified through FIGS. 10 and 11 as well.

Figure 10:
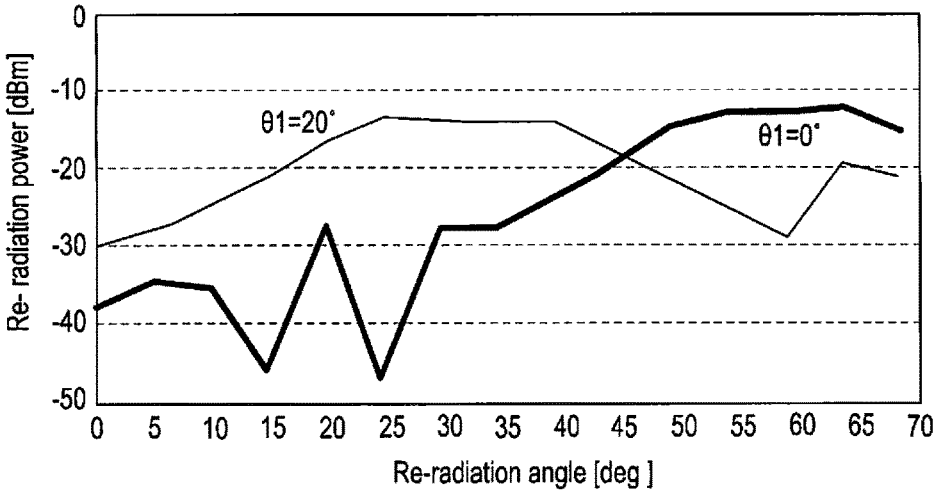

FIG. 10 is a graph obtained by measuring a reradiation characteristic of a reradiation repeater designed to reradiate a radio wave incident from a 20-degree direction in a 30-degree direction (hereinafter, a "third design") according to an embodiment of the present invention. It can be shown that the reradiation repeater according to the third design may reradiate a radio wave I incident from a 20-degree direction in a direction of about 30 degrees. When a radio wave is incident to the reradiation repeater according to the third design from the 0-degree direction, the reradiated radio wave R propagates in a direction of about 60 degrees.

Figure 11:
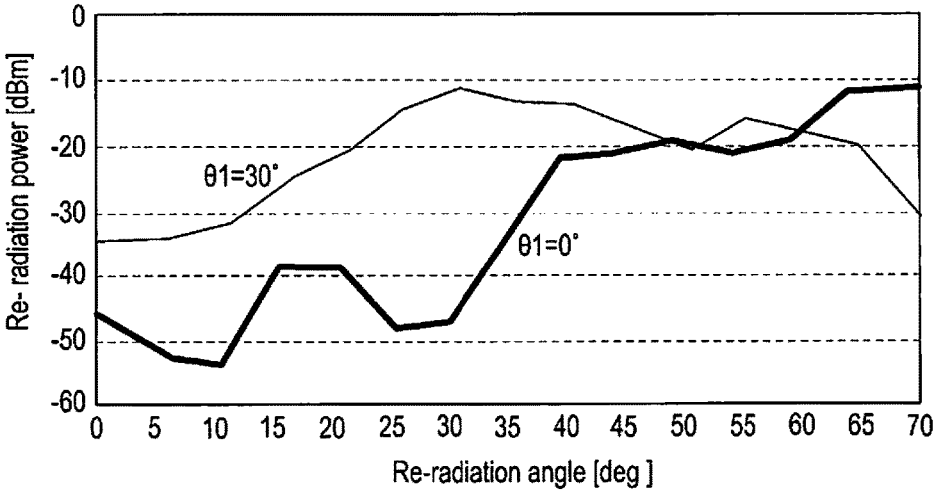

FIG. 11 is a graph obtained by measuring a reradiation characteristic of a reradiation repeater designed to reradiate a radio wave I incident from a 30-degree direction in a 30-degree direction (hereinafter, a "fourth design") according to an embodiment of the present invention. It can be shown that the reradiation repeater according to the fourth design may reradiate a radio wave I incident from a 30-degree direction in a 30-degree direction. It can be seen that when a radio wave is incident to the reradiation repeater according to the fourth design from the 0-degree direction, the reradiated radio wave R propagates in a direction of about 65 degrees or more.

As such, the reradiation repeater 100 according to an embodiment of the present invention may reradiate different radio waves in the same direction through the design and arrangement of unit cells 102. Accordingly, it may facilitate to select an installation location requiring the incident angle and may secure a good reradiation capability even when the installation environment varies. Further, the reradiation repeater 100 is installed in a location with a good radio wave environment and reradiates radio waves to shadow zones to contribute to enhancement of radio wave environment.

Figure 12:
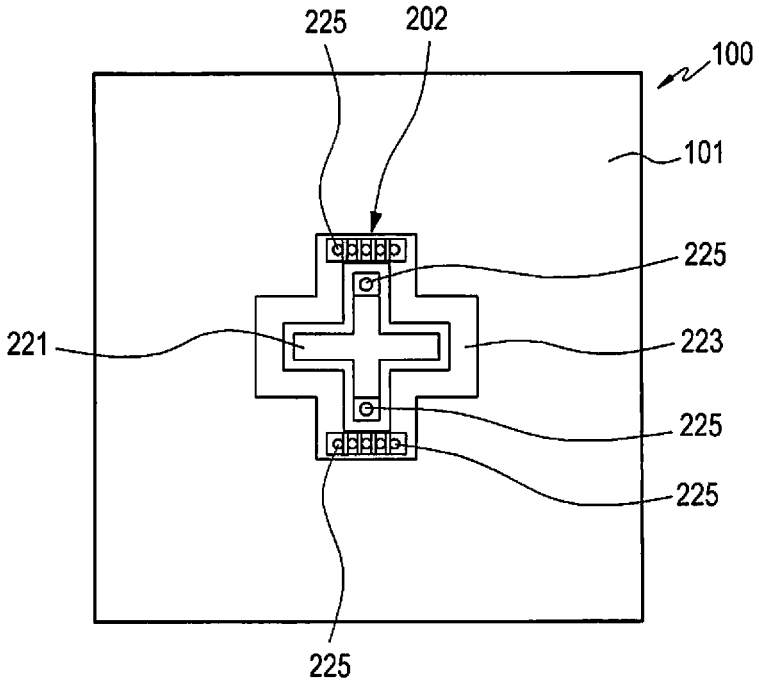
FIG. 12 is a plan view illustrating a unit cell of a reradiation repeater according to another embodiment of the present invention.
Figure 13:
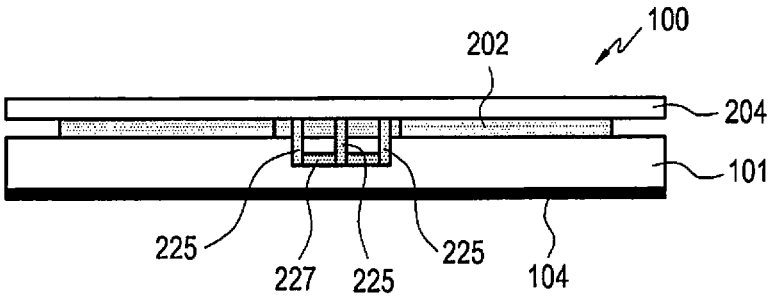
FIG. 13 is a side view illustrating a unit cell of a reradiation repeater according to another embodiment of the present invention.
Figure 14:
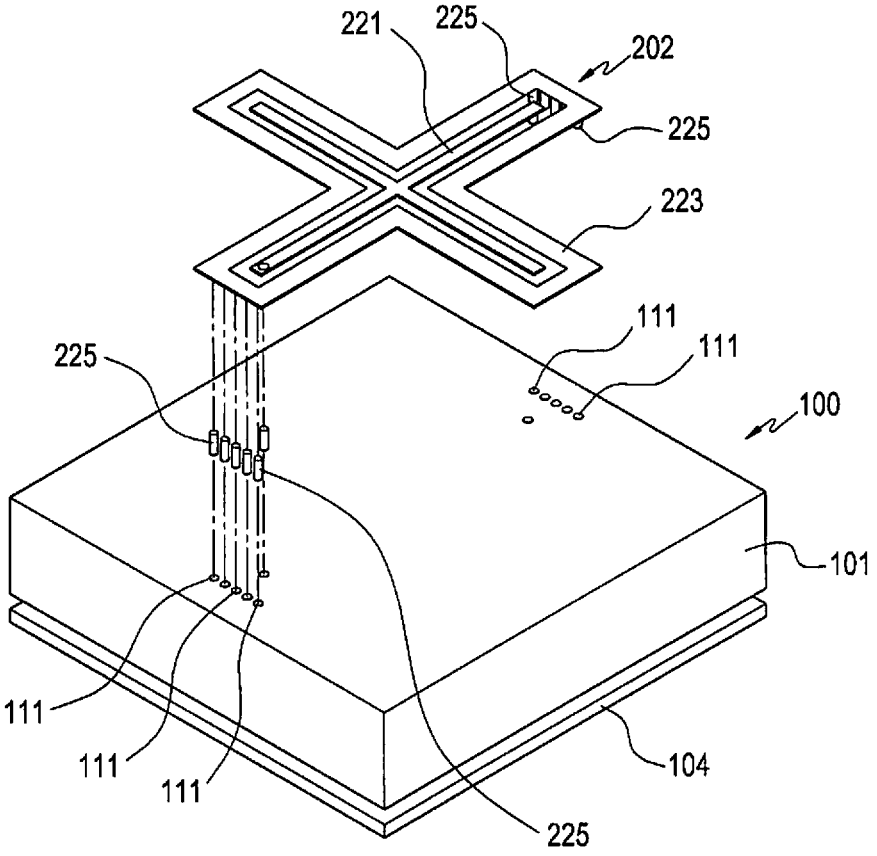
FIG. 14 is a view illustrating a dissembled unit cell of a reradiation repeater according to another embodiment of the present invention.

FIG. 12 is a plan view illustrating a unit cell 202 of a reradiation repeater 100 according to another embodiment of the present invention. FIG. 13 is a side view illustrating a unit cell 202 of a reradiation repeater 100 according to another embodiment of the present invention. FIG. 14 is a view illustrating a dissembled unit cell 200 of a reradiation repeater 100 according to another embodiment of the present invention.

FIG. 14 exemplifies a simplified structure of the unit cell 202. However, the size or thickness of the dielectric substrate or ground conductor or the conductive patterns of the unit cell as actually manufactured may be different from the configuration shown. It is noted that in describing various embodiments the components easy to understand from the description of the above embodiment are denoted with the same reference numerals or omitted, and their detailed description may be skipped.

Referring to FIGS. 12 to 14, each unit cell 202 may include at least one conductive protrusion 225 projecting from a surface of at least one of the first and second conductive patterns 221 and 223. For example, each unit cell 202 may have a stereoscopic structure, not a planar conductive pattern. The shape, size, and number of conductive protrusions 225 may be varied according to embodiments. According to an embodiment of the present invention, a plurality of conductive protrusions 225 may project from a surface, e.g., bottom, of the first and second conductive patterns 221 and 223. Via holes 111 may be formed on the dielectric substrate 101 where the unit cells 202 are arranged, corresponding to the conductive protrusions 225. For example, the conductive protrusions 225 may be accommodated in the via holes 111, respectively. According to an embodiment of the present invention, when the unit cells 202 are arranged on the dielectric substrate 101, the conductive protrusions 225 may be formed of conductors respectively filling the via holes 111.

According to an embodiment of the present invention, the reradiation repeater 100 may further include a conductive patch 227 interconnecting the via holes 111 in the dielectric substrate 101. Use of the conductive protrusions 225 and the conductive patch 227 may diversify the phase characteristics of the unit cells 202.

According to an embodiment of the present invention, the unit cell including, e.g., the conductive protrusion 225, itself, may reradiate radio waves I incident from different angle directions in the same angle direction. The phase characteristics of the unit cell 202 is described with reference to FIG. 15.

Figure 15:
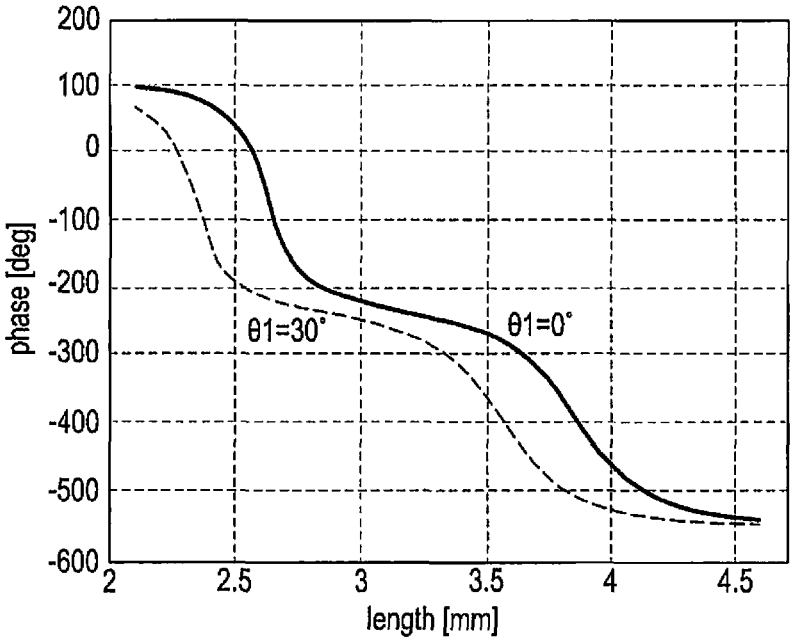
FIG. 15 is a graph illustrating a phase characteristic of a unit cell of a reradiation repeater according to another embodiment of the present invention.

FIG. 15 is a graph illustrating a phase characteristic of a unit cell 202 of a reradiation repeater 100 according to another embodiment of the present invention.

The phase characteristics of unit cell (e.g., the unit cell 102) according to the prior embodiment have been described above with reference to FIG. 7. The unit cell (e.g., the unit cell 102), after manufactured, may have the same phase characteristic even when the incident angle of radio wave varies. By contrast, the unit cell 202 shown in, e.g., FIG. 14 may have different phase characteristics depending on incident angles of radio wave. FIG. 15 is a graph indicating the phase delay characteristic according to the length of the unit cell 202. Referring to FIG. 15, as compared with the phase delay characteristic for the radio wave I incident from the front (e.g., a 0-degree direction), it can be shown that the unit cell 202 exhibits a larger phase delay characteristic for the radio wave I incident from a 30-degree direction. Accordingly, the unit cell 202 may reradiate different radio waves incident from two different angle directions (e.g., a 0-degree direction and a 30-degree direction) in the same direction. For example, if a radio wave R incident from a 0-degree direction and reradiated and another reradiation repeater R incident from a 30-degree direction and reradiated may be reradiated in the same direction by delaying the phase of the other radio wave R by 250 degrees with respect to the radio wave R incident from the 0-degree direction, the unit cell may be designed to have a length of about 2.5 mm as shown in the graph of FIG. 15.

As set forth above, the inclusion of unit cells of a stereoscopic structure may allow the reradiation repeater 100 to reradiate radio waves incident from two different directions in the same direction.

Figure 16:
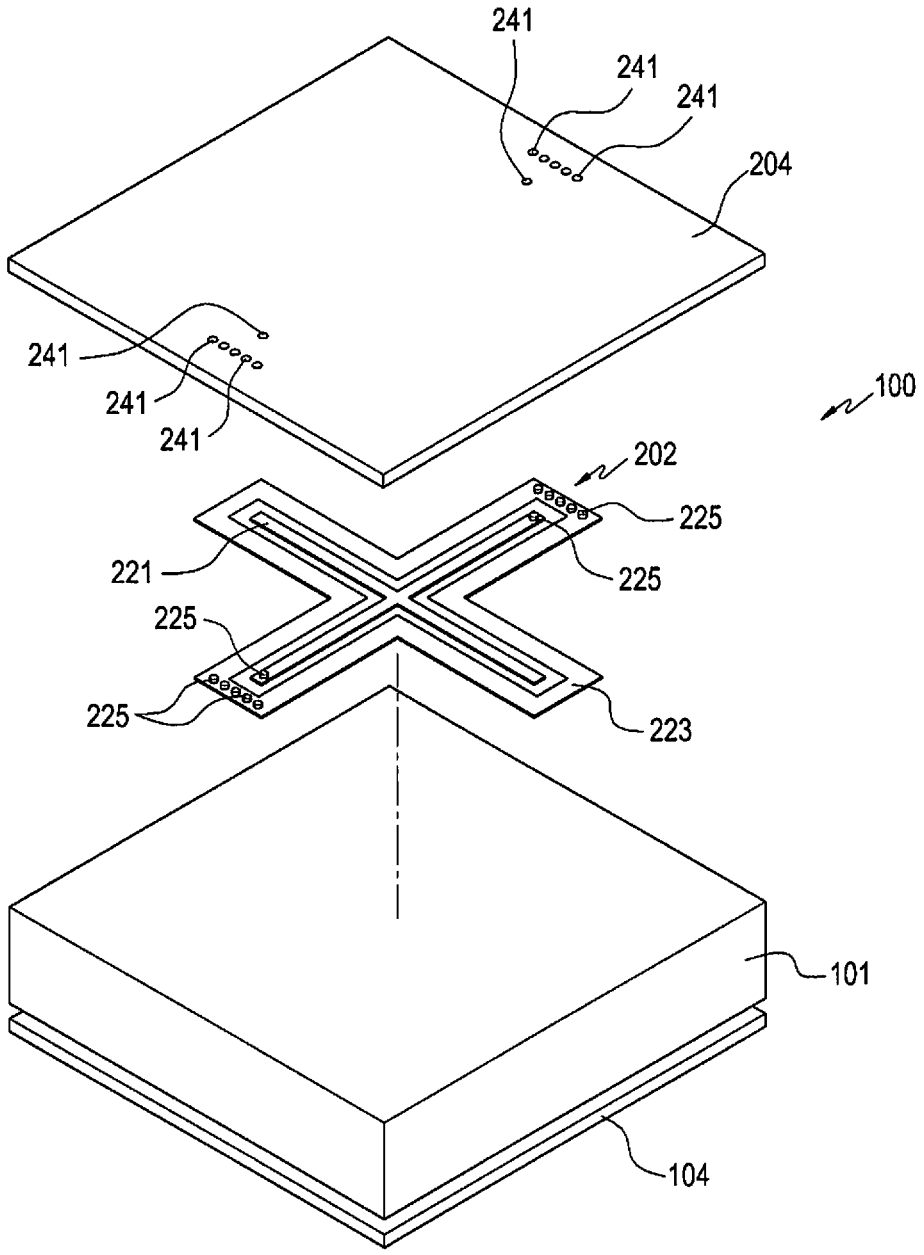
FIG. 16 is a view illustrating a modified unit cell of a reradiation repeater according to another embodiment of the present invention.

FIG. 16 is a view illustrating a modified unit cell 202 of a reradiation repeater 100 according to another embodiment of the present invention.

It is noted that in describing various embodiments the components easy to understand from the description of the above embodiment are denoted with the same reference numerals or omitted, and their detailed description may be skipped.

Referring to FIG. 16, in forming the unit cell 202, the conductive protrusions 225 may be arranged to project to a surface of the dielectric substrate 101. In case the conductive protrusions 225 project to the surface of the dielectric substrate 101, the conductive protrusions 225 may be damaged by an external environment. According to an embodiment of the present invention, since the reradiation repeater 100 further includes a second dielectric substrate 204, the conductive protrusions 225 may be prevented from damage. For example, the second dielectric substrate 204 may be stacked on the dielectric substrate 101 so that the unit cell(s) 202 may be hidden. Via holes 241 may be formed in the second dielectric substrate 204 to accommodate the conductive protrusions 225, respectively. Accordingly, even when the conductive protrusions 225 project to the surface of the dielectric substrate 101, damage to the conductive protrusions 225 by an external environment may be prevented.

Figure 17:
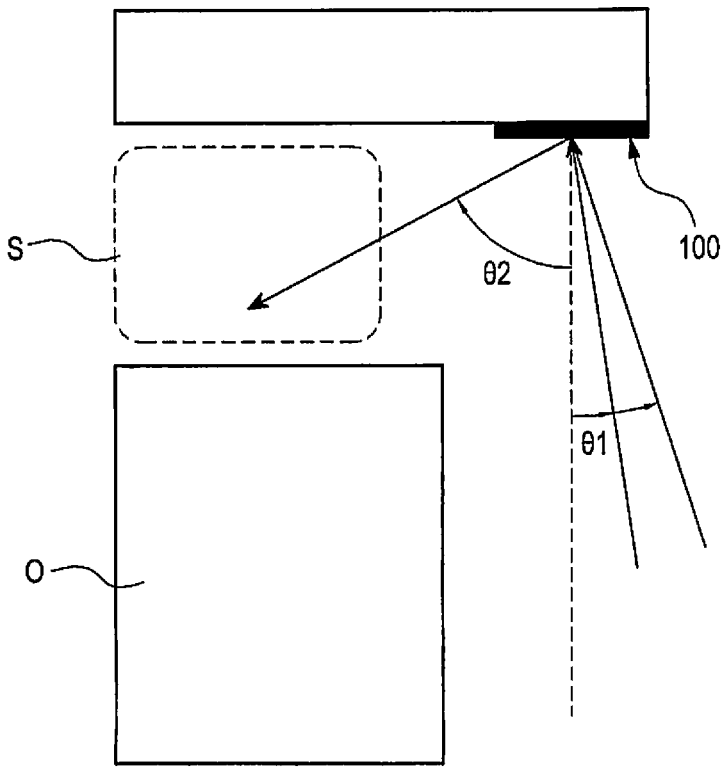
FIG. 17 is a view illustrating an example of installation of a reradiation repeater according to an embodiment of the present invention.

FIG. 17 is a view illustrating an example of installation of a reradiation repeater 100 according to an embodiment of the present invention.

Referring to FIG. 17, according to an embodiment of the present invention, the reradiation repeater 100 may enhance the radio wave environment of a shadow zone S formed by an obstacle O (e.g., a building or an indoor partitioning wall) by reradiating an incident radio wave I to the shadow zone S. As described above, the reradiation repeater 100 may reradiate radio waves incident from two different angle directions in the same angle direction by assigning unit cells 102 to the first or second cell group and arranging them to cross each other or through the own structure of the unit cell 202 (stereoscopic shape).

As set forth supra, according to an embodiment of the present invention, the reradiation repeater 100 may reradiate radio waves from a location with a good radio wave environment to an area with a poor radio wave environment, e.g., a shadow zone, contributing to an enhanced radio wave environment. According to an embodiment of the present invention, the reradiation repeater 100 may be utilized to enhance communication environments between devices installed indoor. For example, in case of connecting a diagnostic device directly contacting a patient's body, such as an ultrasonic wave probe or endoscope to a console box through wireless communication, the wireless communication between the diagonostic device and the console box may be disconnected by the position of the doctor or patient. For example, the doctor's body may be an obstacle to radio waves. According to an embodiment of the present invention, the reradiation repeater 100, when mounted on the ceiling or wall in the room, may allow the wireless communication between the diagnostic device and the console box to remain stable by detouring the obstacle.

As set forth above, according to an embodiment of the present invention, a reradiation repeater may comprise a dielectric substrate, a ground conductor provided on a surface of the dielectric substrate, and a plurality of unit cells provided on another surface of the dielectric substrate, wherein the unit cells reradiate radio waves in the same direction by directing the radio waves which are incident onto the unit cells at different angles to a same direction.

According to an embodiment of the present invention, each of the unit cells may includes a conductive pattern formed on the other surface of the dielectric substrate and at least one conductive protrusion projecting from a surface of the conductive pattern.

According to an embodiment of the present invention, the conductive protrusion may project on the other surface of the dielectric substrate.

The reradiation repeater may further comprise a second dielectric substrate stacked on the other surface of the dielectric substrate and a via hole formed on the second dielectric substrate, wherein the conductive protrusion projecting to the other surface of the dielectric substrate may be accommodated in the via hole.

According to an embodiment of the present invention, the reradiation repeater may further comprise a via hole formed in the dielectric substrate, wherein the conductive protrusion may be formed of a conductor filling the via hole.

According to an embodiment of the present invention, the reradiation repeater may further comprise a conductive patch interconnecting via holes in the dielectric substrate.

According to an embodiment of the present invention, each of the unit cells may be assigned to one of a first cell group reradiating a radio wave incident from a first incident angle direction in a first radiation angle direction and a second cell group reradiating a radio wave incident from a second incident angle direction different from the first incident angle in the first radiation angle direction.

According to an embodiment of the present invention, the first cell group and the second cell group may be alternately arranged on the other surface of the dielectric substrate.

According to an embodiment of the present invention, the reradiation repeater may further comprise dummy patterns arrayed along an edge of the other surface of the dielectric substrate.

According to an embodiment of the present invention, the unit cells may include a first conductive pattern and a second conductive pattern formed to surround the first conductive pattern, and the second conductive pattern may be spaced apart from the first conductive pattern.

according to an embodiment of the present invention, the second conductive pattern may have a closed-loop shape.

According to an embodiment of the present invention, the first conductive pattern may have a "+" shape.

While the present invention has been shown and described with reference to exemplary embodiments thereof, it will be apparent to those of ordinary skill in the art that various changes in form and detail may be made thereto without departing from the spirit and scope of the inventive concept as defined by the following claims.

The invention claimed is:

1. A reradiation repeater, comprising:

a dielectric substrate;

a ground conductor provided on a first surface of the dielectric substrate; and a plurality of unit cells provided on a second surface of the dielectric substrate, wherein each unit cell of the plurality of unit cells reradiates radio waves in the same direction by directing the radio waves which are incident onto the each unit cell of the plurality of unit cells at different angles to the same direction, wherein each unit cell of the plurality of unit cells includes a conductive pattern formed on the second surface of the dielectric substrate, and at least one conductive protrusion projecting from a surface of the conductive pattern, and wherein the conductive protrusion projects into the second surface of the dielectric substrate.

2. The reradiation repeater of claim 1, further comprising:

a second dielectric substrate stacked on the second surface of the dielectric substrate; and a via hole formed on the second dielectric substrate, wherein the conductive protrusion is accommodated in the via hole.

3. The reradiation repeater of claim 1, wherein each unit cell of the plurality of unit cells is assigned to one of a first cell group reradiating a radio wave incident from a first incident angle direction directing to a first radiation angle direction and a second cell group reradiating a radio wave incident from a second incident angle direction different from the first incident angle directing to the first radiation angle direction.

4. The reradiation repeater of claim 3, wherein the first cell group and the second cell group are alternately arranged on the second surface of the dielectric substrate.

5. The reradiation repeater of claim 3, further comprising dummy patterns arrayed along an edge of the second surface of the dielectric substrate.

6. The reradiation repeater of claim 1, wherein each unit cell of the plurality of unit cells include a first conductive pattern and a second conductive pattern formed to surround the first conductive pattern, and wherein the second conductive pattern is spaced apart from the first conductive pattern.

7. The reradiation repeater of claim 6, wherein the second conductive pattern has a closed-loop shape.

8. The reradiation repeater of claim 6, wherein the first conductive pattern has a "+" shape.

9. The reradiation repeater of claim 1, further comprising a via hole formed in the dielectric substrate, wherein another part of the conductive protrusion is formed of a conductor filling the via hole.

10. The reradiation repeater of claim 9, further comprising a conductive patch interconnecting via holes in the dielectric substrate.

* * * * *